US011471723B2

(12) United States Patent
Gao

(10) Patent No.: US 11,471,723 B2
(45) Date of Patent: Oct. 18, 2022

(54) POWER RACK APPARATUS FOR SPOTTING WEIGHTS

(71) Applicant: Minghao Gao, Fairfax, VA (US)

(72) Inventor: Minghao Gao, Fairfax, VA (US)

( * ) Notice: Subject to any disclaimer, the term of this patent is extended or adjusted under 35 U.S.C. 154(b) by 48 days.

(21) Appl. No.: 17/327,414

(22) Filed: May 21, 2021

(65) Prior Publication Data

US 2022/0062687 A1 Mar. 3, 2022

Related U.S. Application Data

(60) Provisional application No. 63/072,488, filed on Aug. 31, 2020.

(51) Int. Cl.
*A63B 21/078* (2006.01)
*A63B 21/00* (2006.01)

(52) U.S. Cl.
CPC ..... *A63B 21/0783* (2015.10); *A63B 21/4034* (2015.10); *A63B 2220/833* (2013.01)

(58) Field of Classification Search
CPC ..... A63B 21/0783; A63B 21/4034; A63B 2220/833; A63B 71/0619; A63B 2220/808; A63B 21/075–0783; A63B 1/00; A63B 1/005; A63B 9/00; A63B 17/00–04; A63B 21/00047; A63B 21/06; A63B 21/078–0783; A63B 24/00; A63B 24/0003; A63B 24/0021; A63B 24/0028; A63B 2220/10; A63B 2220/20; A63B 2220/80; A63B 2220/803; A63B 2225/10
See application file for complete search history.

(56) References Cited

U.S. PATENT DOCUMENTS 4,799,672 A * 1/1989 Barrett ..... A63B 21/078 482/104
6,558,299 B1 * 5/2003 Slattery ..... A63B 21/0783 482/4
6,632,159 B1 * 10/2003 Slattery ..... A63B 21/078 482/4
7,112,162 B2 9/2006 Greenland
7,578,774 B1 8/2009 Zetterberg
7,591,771 B2 * 9/2009 Rullestad ..... A63B 21/078 482/112
7,963,886 B1 * 6/2011 Schwinn ..... A63B 21/0783 482/99
8,105,206 B2 1/2012 Rindfleisch
10,864,401 B2 * 12/2020 Schween ..... A63B 21/151
(Continued)

*Primary Examiner* — Joshua Lee
*Assistant Examiner* — Catrina A Letterman

(57) ABSTRACT

A power rack apparatus is provided for spotting weights. The power rack apparatus allows a user to lift weights to failure without the need of a human spotter. The power rack apparatus includes a power rack frame, a weight-catching system, and a controller. The power rack frame is a standard structural frame of a power rack that allows a user to rack weights after he or she has completed a weightlifting workout. The weight-catching system spots weights for the user using at least one chain drive mechanism, a first racking arm, and a second racking arm. Through the weight-catching system, the user is allowed to lift weights to failure and is spotted by weight-catching system when necessary. The controller manages and controls the weight-catching system in order for the weight-catching system to effectively spot weights for the user.

19 Claims, 6 Drawing Sheets

(56) References Cited

U.S. PATENT DOCUMENTS

| | | | | |
|---|---|---|---|---|
| 2006/0094571 | A1 | 5/2006 | Polidi | |
| 2007/0072750 | A1* | 3/2007 | Andrews | A63B 21/078 482/94 |
| 2007/0203003 | A1* | 8/2007 | Brawner | A63B 21/078 482/104 |
| 2017/0080277 | A1* | 3/2017 | Rogers | A63B 21/078 |
| 2018/0064994 | A1* | 3/2018 | Back | A63B 21/0783 |
| 2018/0290001 | A1* | 10/2018 | Baek | A63B 71/0036 |
| 2022/0233908 | A1* | 7/2022 | Neuhaus | A63B 21/0626 |

* cited by examiner

POWER RACK APPARATUS FOR SPOTTING WEIGHTS

The current application claims a priority to the U.S. Provisional Patent application Ser. No. 63/072,488 filed on Aug. 31, 2020.

FIELD OF THE INVENTION

The present invention generally relates to a weightlifting exercise equipment.

More specifically, the present invention is power rack apparatus that allows a user to lift weights to failure, without the need for a human spotter.

BACKGROUND OF THE INVENTION

Weightlifters often train themselves by lifting heavier and heavier weights to build muscle mass. However, this activity can be dangerous when mistakes happen. Heavy weights can fall on the user causing serious injury or sometimes death. At a gym setting, weightlifters often have a spotter, or someone to help in case the weightlifter can no longer handle the force of the weight. However, someone is not always available to help catch free falling weight. Current tools to aid weightlifters include fixed arms that protrude from the power rack. However, this tool limits the space the user can use to perform their exercises and do not provide a quick adaptable setup for different exercises.

An objective of the present design is to provide the user with a power rack apparatus that replaces the need for a spotter. The power rack apparatus comprises mechanically powered arms guided by sensors that detect the position of the weights a weightlifter is using. The user may perform a plurality of different exercises from squats and bench presses to overhead presses. The arrangement and position of the arms also provides the user with enough space for large ranges of motion. The arms may also be manually configurable by foot pedals that move the arms up and down the power rack.

DETAIL DESCRIPTIONS OF THE INVENTION

Figure 1:
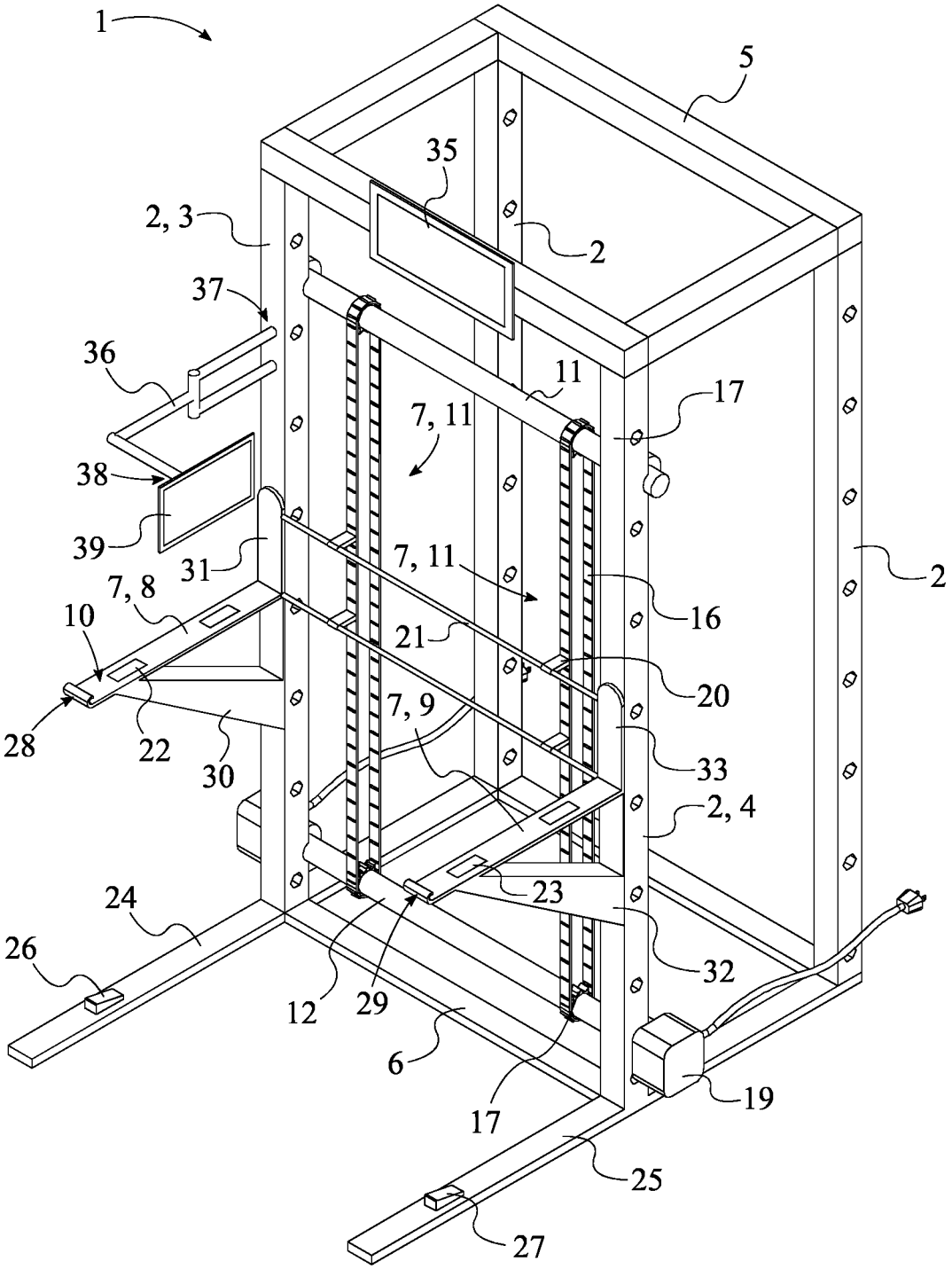
FIG. 1 is a front perspective view of the present invention.

All illustrations of the drawings are for the purpose of describing selected versions of the present invention and are not intended to limit the scope of the present invention.

In reference to FIGS. 1 through 6, the present invention is a power rack apparatus for spotting weights. More specifically, the present invention allows a user to lift weights to failure without the need of a human spotter. In the preferred embodiment, the present invention comprises a power rack frame 1, a weight-catching system 7, and a controller 34. The power rack frame 1 is a standard structural frame of a power rack that allows a user to rack weights after he or she has completed a weightlifting workout. The weight-catching system 7 spots weights for the user, thus allowing the user to lift weights to failure. The controller 34 manages and controls the weight-catching system 7 in order for the weight-catching system 7 to effectively spot weights for the user.

The general configuration of the aforementioned components allows the present invention to effectively spot weights for a user. As mentioned previously and with reference to FIGS. 1 and 2, the power rack frame 1 is a standard structural frame of a power rack, and therefore, comprises a plurality of lateral posts 2, a top base 5, and a bottom base 6. The plurality of lateral posts 2 comprises a first front post 3 and a second front post 4. The plurality of lateral posts 2, the top base 5, and the bottom base 6 are arranged into a prismatic configuration as found in standard power rack designs. The first front post 3 and the second front post 4 are positioned parallel and adjacent to each other. This arrangement positions the first front post 3 and the second front post 4 to be the main mounting posts of the power rack frame 1. Moreover, the plurality of lateral posts 2 is positioned parallel and offset from each other in order to form the structural elements of the rectangular prism. Each of the plurality of lateral posts 2 are positioned normal to the top base 5 and bottom base 6, and each of the plurality of lateral posts 2 are connected in between the top base 5 and the bottom base 6. This arrangement forms the full structural frame of a rectangular prism as is standard in power rack designs.

Figure 2:
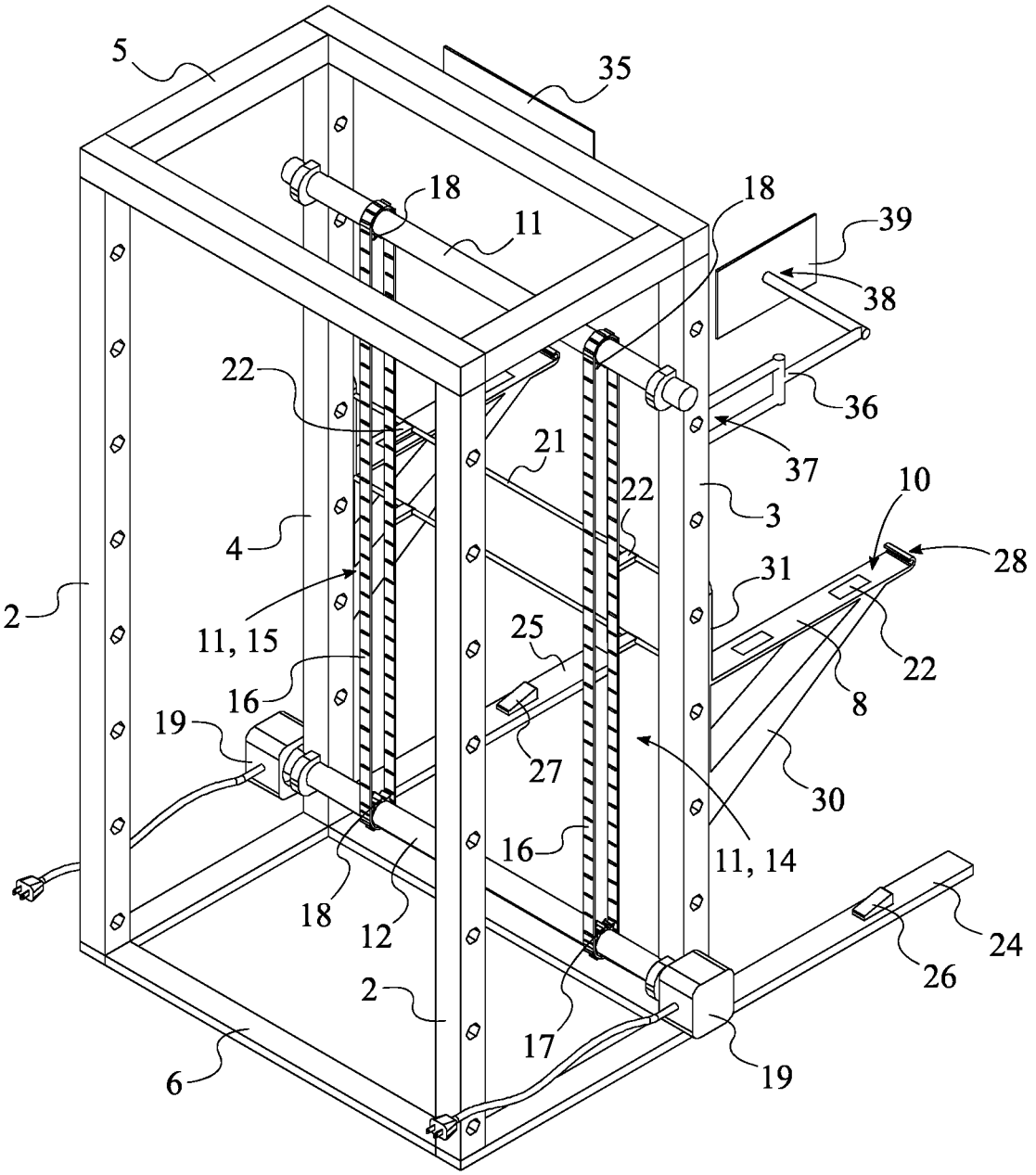
FIG. 2 is a rear perspective view of the present invention.
Figure 6:
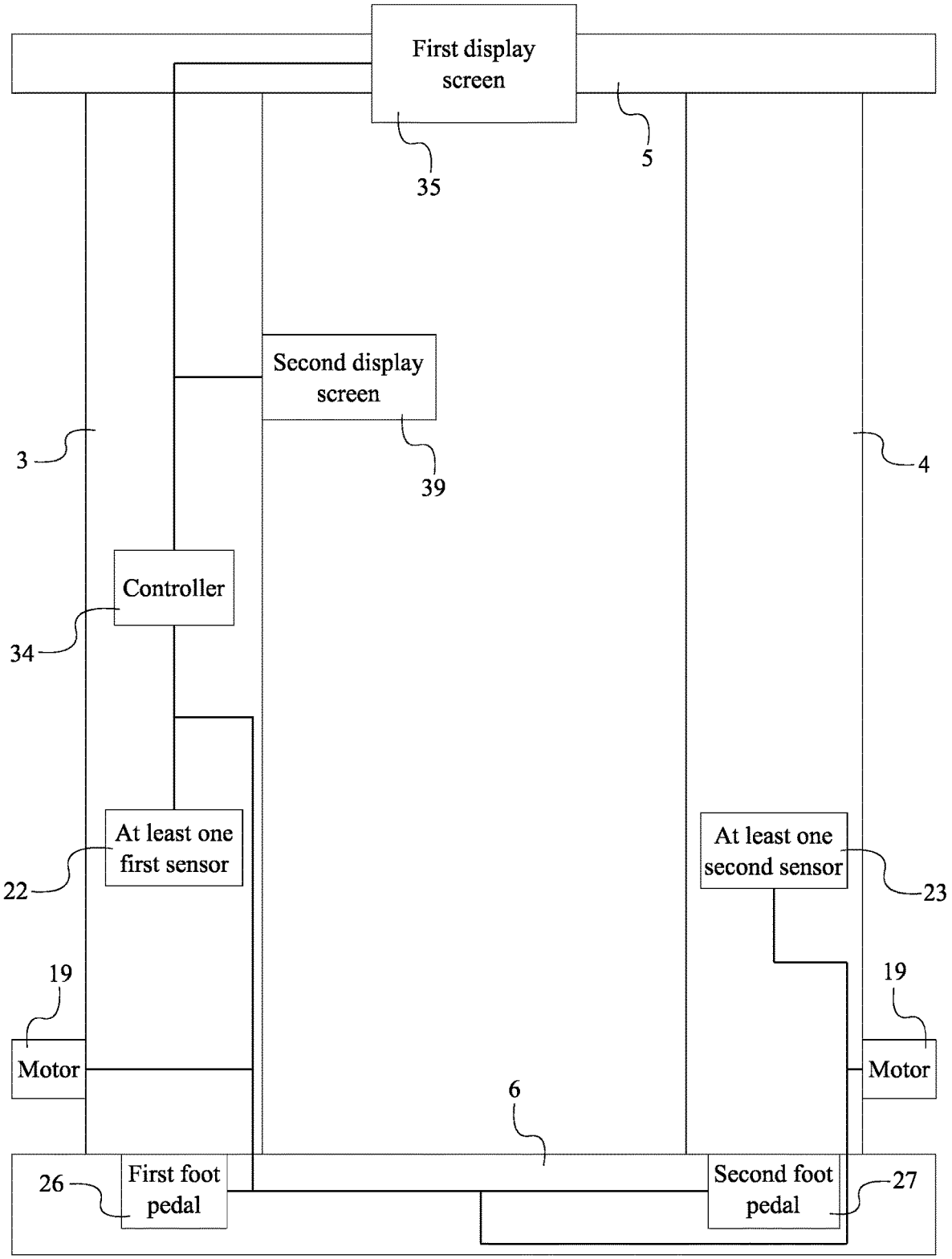
FIG. 6 is a schematic diagram illustrating the electronic connections of the present invention.

With reference to FIGS. 1 and 2, the weight-catching system 7 comprises a first racking arm 8, a second racking arm 9, an upper support beam 11, a lower support beam 12, and at least one chain drive mechanism 13. The upper support beam 11 and the lower support beam 12 are mounted in between the first front post 3 and the second front post 4. Preferably, the upper support beam 11 and the lower support beam 12 are connected using bearing clamps in between the first front post 3 and the second front post 4. Further, the upper support beam 11 and the lower support beam 12 are positioned parallel and offset from each other in order to create two offset mounting points for the at least one chain drive mechanism 13. The at least one chain drive mechanism 13 is mounted in between the upper support beam 11 and the lower support beam 12 in order to allow the at least one chain drive mechanism 13 to transmit mechanical power towards the upper support beam 11 or towards the lower support beam 12. The first racking arm 8 is slidably mounted along the first front post 3 and the second racking arm 9 is slidably mounted along the second front post 4. This arrangement allows the first racking arm 8 and the second racking arm 9 to be raised or lowered in order to catch the weight being lifted by the user if necessary. The at least one chain drive mechanism 13 is operatively coupled to the first racking arm 8 and the second racking arm 9, wherein the at least one chain drive mechanism 13 is used to simultaneously raise and simultaneously lower the first racking arm 8 and the second racking arm 9. In more detail, the at least one chain drive mechanism 13 comprises at least one mechanism that allows both the first racking arm 8 and the second racking arm 9 to be simultaneously raised or lowered to effectively catch the weight being lifted by the user if necessary. With reference to FIG. 6, the controller 34 is mounted within the power rack frame 1 in order to be concealed and protected by the power rack frame 1. Moreover, the at least one chain drive mechanism 13 is electronically connected to the controller 34 in order to remotely raise or lower the first racking arm 8 and the second racking arm 9.

Figure 3:
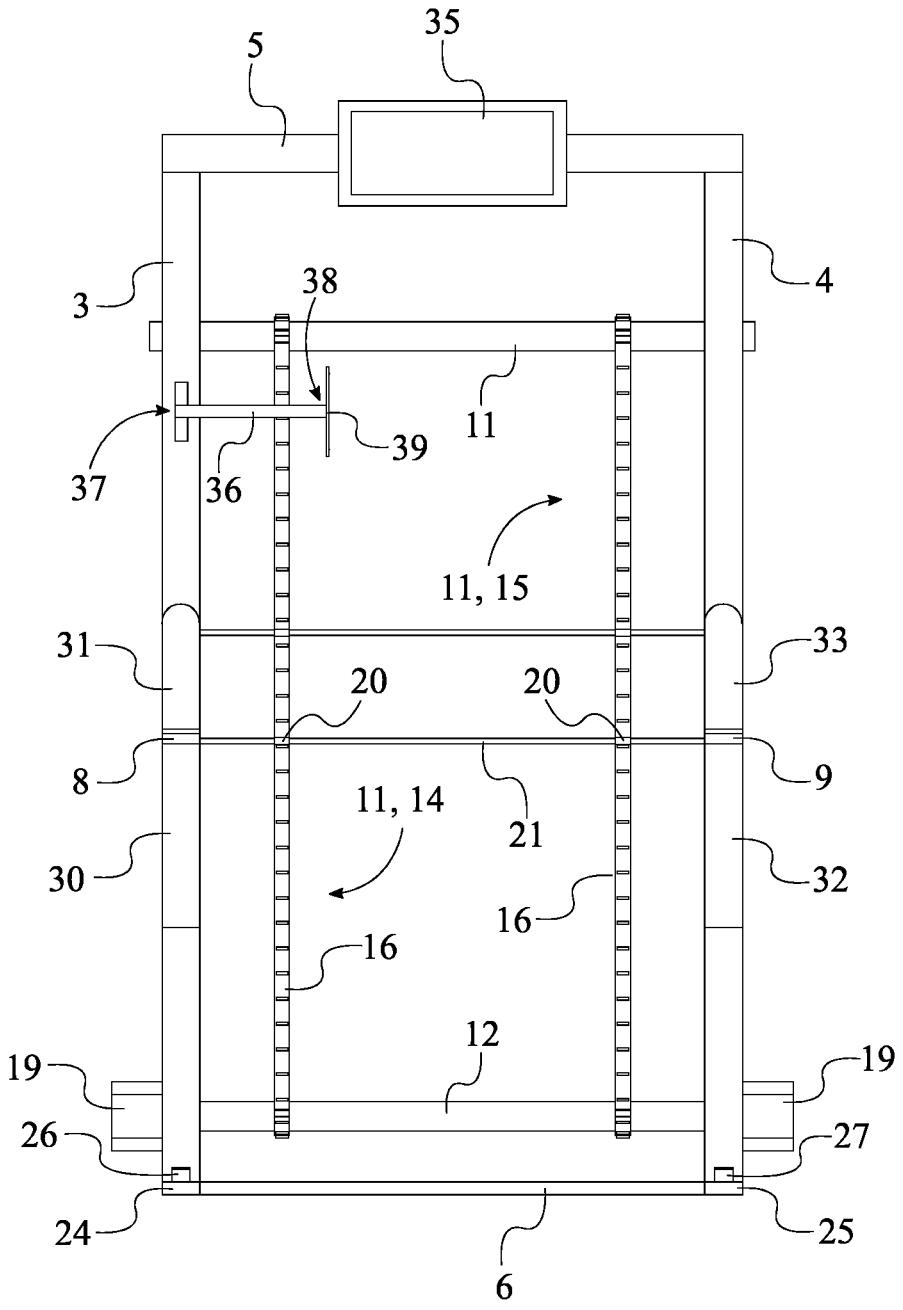
FIG. 3 is a front view of the present invention.

In order for the present invention to effectively catch heavy weights and with reference to FIGS. 2 and 3, the at least one chain drive mechanism 13 comprises a first chain drive mechanism 14, a second chain drive mechanism 15, and at least one drive bar 21. With the first chain drive mechanism 14 and the second chain drive mechanism 15, enough torque force can be applied to simultaneously raise or lower the first racking arm 8 and the second racking arm 9 with heavy weights situated on the first racking arm 8 and the second racking arm 9. The at least one drive bar 21 establishes the physical connection between the first racking arm 8 and the at least one chain drive mechanism 13, and the physical connection between the second racking arm 9 and the at least one chain drive mechanism 13. The first chain drive mechanism 14 and the second chain drive mechanism 15 each comprise a transmission chain 16, a drive gear 17, a driven gear 18, a motor 19, and at least one coupler 20. The at least one drive bar 21 is connected in between the first racking arm 8 and the second racking arm 9 and is laterally mounted to the transmission chain 16 by the at least one coupler 20 in order to establish the physical connection between the first racking arm 8 and the at least one chain drive mechanism 13, and the physical connection between the second racking arm 9 and the at least one chain drive mechanism 13. Preferably, the at least one drive bar 21 includes two drive bars in order to provide ample support between the first racking arm 8 and the second racking arm 9. Also, the at least one coupler 20 includes two couplers for each drive bar in this embodiment, and the at least one coupler 20 may be any type of attachment mechanism such as, but not limited to, a clip or clamp. The transmission chain 16 is tensionally engaged about the drive gear 17 and the driven gear 18 in order in order to effectively transmit mechanical energy from the drive gear 17 to the driven gear 18. The motor 19 is operatively coupled to the drive gear 17, wherein the motor 19 is used to rotate the drive gear 17. In more detail, the motor 19 applies a torque force to the drive gear 17, and this torque force is transmitted to the driven gear 18 by the transmission chain 16. A motor mount is used to secure the motor 19 to the power rack frame in order to control the vibration produced by the motor 19. Moreover and with reference to FIG. 6, the motor 19 is electronically connected to the controller 34 in order for the motor 19 to be remotely actuated.

In order for the weight-catching system 7 to effectively raise and lower both the first racking arm 8 and the second racking arm 9 and with reference to FIGS. 2, the following arrangement is preferred. The driven gear 18 of the first chain drive mechanism 14 and the driven gear 18 of the second chain drive mechanism 15 are rotatably mounted to the upper support beam 11. Further, the driven gear 18 of first chain drive mechanism 14 and the driven gear 18 of the second chain drive mechanism 15 are positioned offset from each other along the upper support beam 11. Through this arrangement, the first chain drive mechanism 14 can be selected as the sole mechanism used to raise the first racking arm 8 and the second racking arm 9. In further detail, only the motor 19 of the first chain drive mechanism 14 is actuated to raise the first racking arm 8 and the second racking arm 9. Similarly, the drive gear 17 of the second chain drive mechanism 15 and the drive gear 17 of the first drive mechanism are rotatably mounted to the lower support beam 12. Further, the drive gear 17 of second chain drive mechanism 15 and the drive gear 17 of the first chain drive mechanism 14 are positioned offset from each other along the lower support beam 12. Through this arrangement, the second chain drive mechanism can be selected as the sole mechanism used to lower the first racking arm 8 and the second racking arm 8. In further detail, only the motor 19 of the second chain drive mechanism 15 is actuated to lower the first racking arm 8 and the second racking arm 9.

Alternatively, both the first chain drive mechanism 14 and the second chain drive mechanism 15 can work in conjunction to raise or lower the first racking arm 8 and the second racking arm 9. In this embodiment, the motor 19 of each the first chain drive mechanism 14 and the second chain drive mechanism 15 can be actuated clockwise or counterclockwise. The rotation of the motor 19 can be controlled by the controller 34. Thus, a larger torque force can be converted into a vertical force to raise or lower both the first racking arm 8 and the second racking arm 9.

The weight-catching system 7 may include multiple techniques on how the system effectively spots weights for the user. In order to automatically raise or lower the first racking arm 8 and the second racking arm 9 and with reference to FIG. 1, the weight-catching system 7 may further comprise at least one first sensor 22 and at least one second sensor 23. The at least one first sensor 22 and the at least one second sensor 23 may any type of motion and/or proximity sensor able to detect when weights are being lifted by the user. The first racking arm 8 and the second racking arm 9 each comprise a weight-receiving surface 10. The weight-receiving surface 10 is oriented towards the top base 5 and is the surface where the user can rack a weight after a workout. The at least one first sensor 22 is integrated into the weight-receiving surface 10 of the first racking arm 8. Thus, the weight-catching system 7 can detect when a weight is moving over the first racking arm 8. Similarly, the at least one second sensor 23 is integrated into the weight-receiving surface 10 of the second racking arm 9. Thus, the weight-catching system 7 can detect when a weight is moving over the second racking arm 9. Moreover and with reference to FIG. 6, the at least one first sensor 22 and the at least one second sensor 23 is electronically connected to the controller 34. Thus, the at least one first sensor 22 and the at least one second sensor 23 can be managed and controlled by the controller 34. In more detail, the controller 34 can be programmed to detect when a weight has stopped moving during a workout through the at least one first sensor 22 and the at least one second sensor 23. This suggests that the user is stuck and is need of a spot. Therefore, the controller 34 can actuate the at least one chain drive mechanism 13 in order to raise or lower both the first racking arm 8 and the second racking arm 9 in order to catch the weight and, therefore, relieve the user.

Alternatively and in order for the user to manually raise or lower the first racking arm 8 and the second racking arm 9 and with reference to FIG. 1, the weight-catching system 7 may further comprise a first leg 24, a second leg 25, a first foot pedal 26, and a second foot pedal 27. The first leg 24 and the second leg 25 are connected coplanar to the bottom base 6 in order to be easily accessed by the user. The first leg 24 is positioned perpendicular and adjacent to the first front post 3. This arrangement allows the user to contact the first leg 24 with one of his or her feet. Similarly, the second leg 25 is positioned perpendicular and adjacent to the second front post 4. This arrangement allows the user to contact the second leg 25 with the other foot. Moreover, the first leg 24 and the second leg 25 are positioned parallel and offset from each other. This provides an area for the user to stand in between the first leg 24 and the second leg 25, and thus, only reach the first leg 24 and the second leg 25 when desired. The first leg 24 and the second leg 25 provide surfaces to receive the first foot pedal 26 and the second foot pedal 27. The first foot pedal 26 is laterally mounted onto the first leg 24 in order to be easily accessed by one foot of the user.

Similarly, the second foot pedal 27 is laterally mounted onto the second leg 25 in order to be easily accessed by the other foot of the user. Furthermore and with reference to FIG. 6, the first foot pedal 26 and the second foot pedal 27 are electronically connected to the controller 34. In more detail, the first foot pedal 26 and the second foot pedal 27 can be pressed by one foot of the user to operate the at least one chain drive mechanism 13. For example, when the first foot pedal 26 is pressed, the first racking arm 8 and the second racking arm 9 are raised to catch a weight. Alternatively, when the second foot pedal 27 is pressed, the first racking arm 8 and the second racking arm 9 are lowered to catch a weight.

In order for the user to view training videos for proper weightlifting techniques, and with reference to FIG. 1, the present invention may further comprise a first display screen 35. The first display screen 35 is laterally mounted to the top base 5 and is positioned in between the first front post 3 and the second front post 4. This arrangement positions the first display screen 35 in an optimal viewing point for the user. Moreover, the first display screen 35 is oriented away from the power rack frame 1 in order to be viewed by the user when the user is waiting in between sets of workout. Further and with reference to FIG. 6, the first display screen 35 is electronically connected to the controller 34 in order to be remotely operated. In another embodiment, at least one microphone can be integrated within the first display screen 35. Through the at least one microphone, the user can make voice commands in order to operate the first display screen 35 or to actuate the at least one chain drive mechanism 13 in order to raise or lower the first racking arm 8 and the second racking arm 9. The first display screen 35 is preprogrammed to include training videos to improve the weightlifting techniques of the user, but the first display screen 35 can additionally be used to entertain the user during a workout.

In order for the user to mount a mobile phone or similar device and with reference to FIG. 1, the present invention may further comprise a device-mounting adjustable arm 36. The device-mounting adjustable arm 36 comprises a proximal arm end 37 and a distal arm end 38. The proximal arm end 37 is laterally mounted to the first front post 3. In more detail, the proximal arm end 37 is mounted to the first front post 3 through a hinge mechanism and a set of fasteners. The user can pivotably mount a mobile phone or similar device to the distal arm end 38 in order to interact with the mobile phone or similar device during a workout. In another embodiment, the present invention may further comprise a second display screen 39 in order to entertain the user during a workout. The second display screen 39 is pivotably mounted to the distal arm end 38. This arrangement allows the second display screen 39 to be adjusted by the user when desired. Further and with reference to FIG. 6, the second display screen 39 is electronically connected to the controller 34. This allows the second display screen 39 to be remotely operated. In another embodiment, the second display screen 39 includes a touch-screen interface. This allows the second display screen 39 to be used to remotely operate the at least one chain drive mechanism 13 in order to raise or lower the first racking arm 8 and the second racking arm 9.

Figure 4:
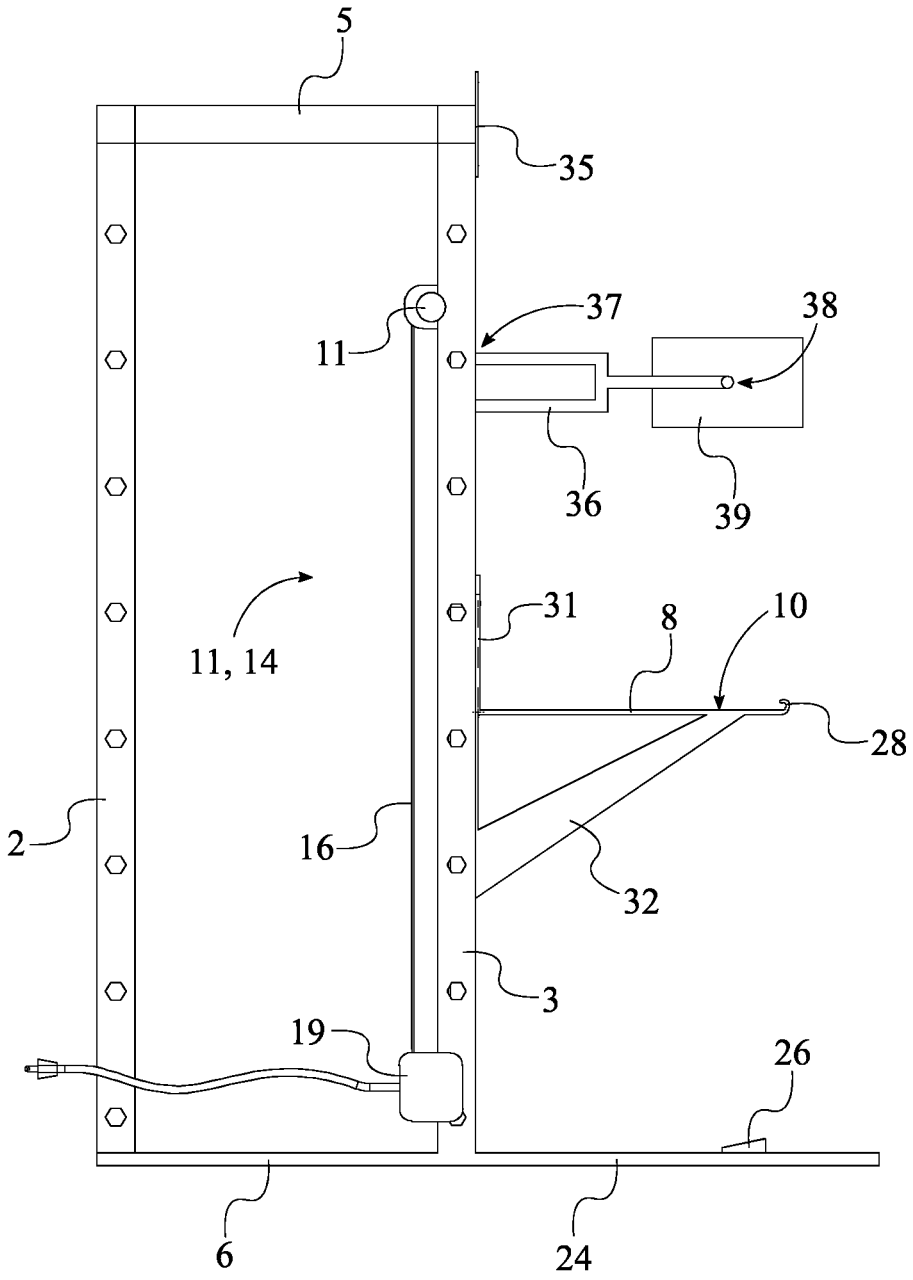
FIG. 4 is a left-side view of the present invention.
Figure 5:
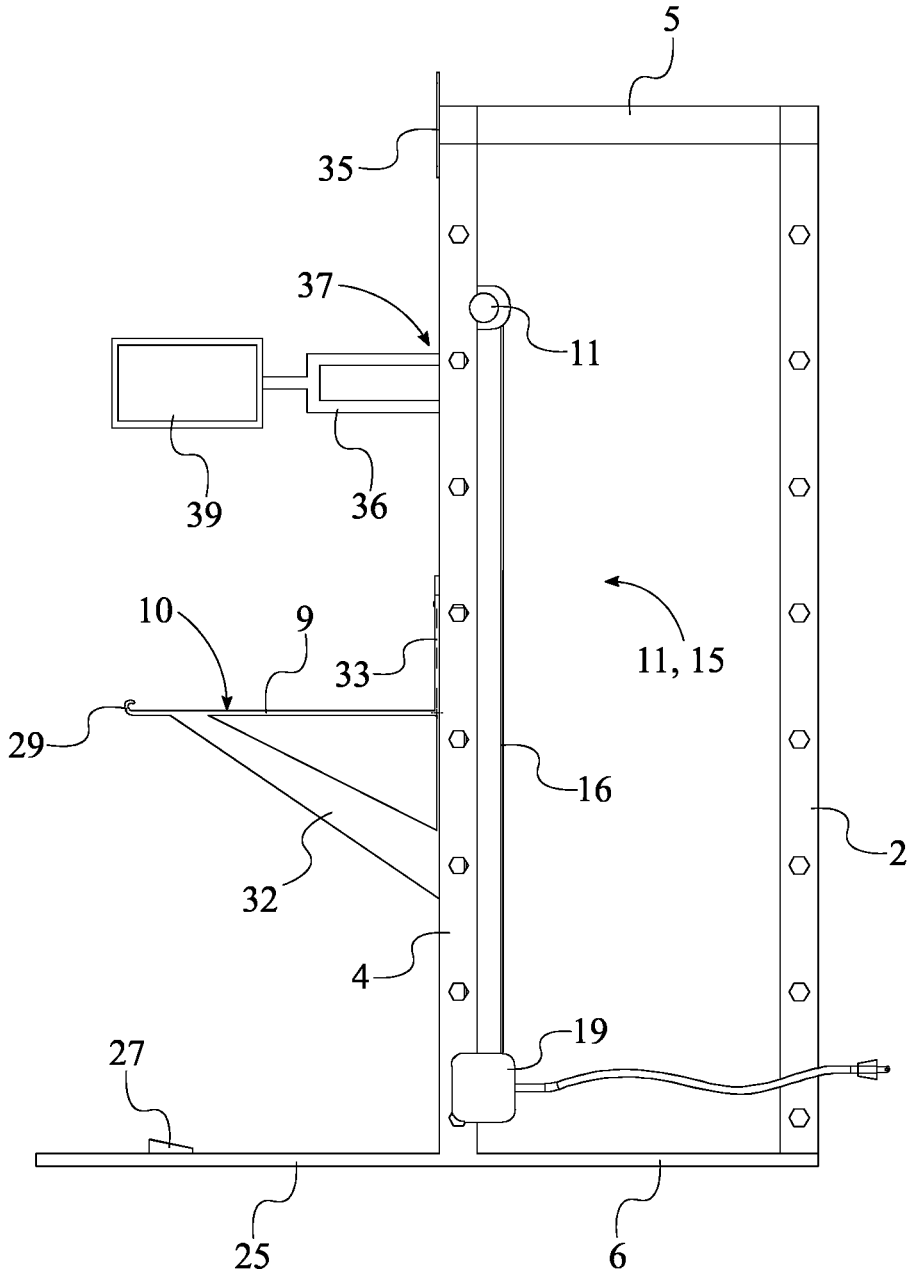
FIG. 5 is a right-side view of the present invention.

In order to prevent a weight from sliding off the first racking arm 8 and the second racking arm 9 and with reference to FIGS. 4 and 5, the weight-catching system 7 may further comprise a first weight catch feature 28 and a second weight catch feature 29. The first weight catch feature 28 and second weight catch feature 29 are preferably hook-shaped structures designed to prevent weight bars from sliding off the first racking arm 8 and the second racking arm 9. The first weight catch feature 28 is terminally connected to the first racking arm 8, opposite the first front post 3. This arrangement positions the first weight catch feature 28 to prevent a weight bar from sliding off the first racking arm 8. In more detail, a weight bar is restricted to only sliding between the first front post 3 and the first weight catch feature 28 when the weight bar is racked on the present invention. Similarly, the second weight catch feature 29 is terminally connected to the second racking arm 9, opposite the second front post 4. This arrangement positions the second weight catch feature 29 to prevent a weight bar from sliding off the second racking arm 9. In more detail, a weight bar is restricted to only sliding between the second front post 4 and the second weight catch feature 29 when the weight bar is racked on the present invention.

In order to provide more rigidity and stability to the first racking arm 8 and the second racking arm 9 and with reference to FIGS. 4 and 5, the weight-catching system 7 may further comprise a first counterfort 30, a first carriage 31, a second counterfort 32, and a second carriage 33. The first carriage 31 is a mechanism that allows the first racking arm 8 to slide along the first front post 3 along with the first counterfort 30. Similarly, the second carriage 33 is a mechanism that allows the second racking arm 9 to slide along the second front post 4 along with the second counterfort 32. The first carriage 31 is slidably connected onto the first front post 3. More specially, the first carriage 31 may be mounted to the first front post 3 using a track and rail assembly where the first carriage 31 selectively locks in place as the first carriage 31 is slid along the first front post 3 when enough force is applied. The first racking arm 8 is positioned perpendicular to the first front post 3 in order to effectively allow a weight to be racked on the first racking arm 8. Further, the first racking arm 8 is connected onto the first carriage 31, opposite to the first front post 3, and the first counterfort 30 is connected in between the first racking arm 8 and the first carriage 31. This arrangement allows the first racking arm 8 and the first counterfort 30 to slide together along the first front post 3 through the first carriage 31. Moreover, the first counterfort 30 provides rigidity and stability to the first racking arm 8. Similarly, the second carriage 33 is slidably connected onto the second front post 4. More specially, the second carriage 33 may be mounted to the second front post 4 using a track and rail assembly where the second carriage 33 selectively locks in place as the second carriage 33 is slid along the second front post 4 when enough force is applied. The second racking arm 9 is positioned perpendicular to the second front post 4 in order to effectively allow a weight to be racked on the second racking arm 9. Further, the second racking arm 9 is connected onto the second carriage 33, opposite to the second front post 4, and the second counterfort 32 is connected in between the second racking arm 9 and the second carriage 33. This arrangement allows the second racking arm 9 and the second counterfort 32 to slide together along the second front post 4 through the second carriage 33. Moreover, the second counterfort 32 provides rigidity and stability to the second racking arm 9.

The electrical and electronic components of the present invention can be powered through various methods. In the preferred embodiment, the present invention is powered using electrical plugs that can be connected to standard electrical outlets. Preferably, one electrical plug is connected to the motor 19 of the first chain drive mechanism 14 and the other electrical plug is connected to the motor 19 of the second chain drive mechanism 15. A plurality of wires may be used to route the electrical power from the electrical plugs to the other electrical and electronic components of the present invention. In another embodiment, the present invention is powered using a rechargeable battery source. The rechargeable battery source may be mounted within any one of the plurality of lateral posts 2. The rechargeable battery source is electrically connected to all the electrical and electronic components of the present invention.

Although the invention has been explained in relation to its preferred embodiment, it is to be understood that many other possible modifications and variations can be made without departing from the spirit and scope of the invention as hereinafter claimed.

What is claimed is:

1. A power rack system for spotting weights comprising:

a power rack frame;

a weight-catching system;

a controller;

the power rack frame comprising a plurality of lateral posts, a top base, and a bottom base;

the weight-catching system comprising a first racking arm, a second racking arm, an upper support beam, a lower support beam, and at least one chain drive mechanism;

the plurality of lateral posts comprising a first front post and a second front post;

the plurality of lateral posts, the top base, and the bottom base being arranged into a prismatic configuration;

the first front post and the second front post being positioned parallel and adjacent to each other;

the upper support beam and the lower support beam being mounted in between the first front post and the second front post;

the upper support beam and the lower support beam being positioned parallel and offset from each other;

the at least one chain drive mechanism being mounted in between the upper support beam and the lower support beam;

the first racking arm being slidably mounted along the first front post;

the second racking arm being slidably mounted along the second front post;

the at least one chain drive mechanism being operatively coupled to the first racking arm and the second racking arm, wherein the at least one chain drive mechanism is used to simultaneously raise and simultaneously lower the first racking arm and the second racking arm;

the controller being mounted within the power rack frame; and the at least one chain drive mechanism being electronically connected to the controller.

2. The power rack system for spotting weights as claimed in claim 1 comprising:

the at least one chain drive mechanism comprising a first chain drive mechanism, a second chain drive mechanism, and at least one drive bar;

the first chain drive mechanism and the second chain drive mechanism each comprising a transmission chain, a drive gear, a driven gear, a motor, and at least one coupler;

the at least one drive bar being connected in between the first racking arm and the second racking arm;

the transmission chain being tensionally engaged about the drive gear and the driven gear;

the motor being operatively coupled to the drive gear, wherein the motor is used to rotate the drive gear;

the motor being electronically connected to the controller; and the at least one drive bar being laterally mounted to the transmission chain by the at least one coupler.

3. The power rack system for spotting weights as claimed in claim 2 comprising:

the drive gear of the first chain drive mechanism and the driven gear of the second drive mechanism being rotatably mounted to the upper support beam;

the drive gear of the first chain drive mechanism and the driven gear of the second chain drive mechanism being positioned offset from each other along the upper support beam;

the drive gear of the second chain drive mechanism and the driven gear of the first chain drive mechanism being rotatably mounted to the lower support beam; and the drive gear of the second chain drive mechanism and the driven gear of the first chain drive mechanism being positioned offset from each other along the lower support beam.

4. The power rack system for spotting weights as claimed in claim 1 comprising:

the weight-catching system further comprising at least one first sensor and at least one second sensor;

the first racking arm and the second racking arm each comprise a weight-receiving surface;

the weight-receiving surface being oriented towards the top base;

the at least one first sensor being integrated into the weight-receiving surface of the first racking arm;

the at least one second sensor being integrated into the weight-receiving surface of the second racking arm; and the at least one first sensor and the at least one second sensor being electronically connected to the controller.

5. The power rack system for spotting weights as claimed in claim 1 comprising:

the weight-catching system further comprising a first leg, a second leg, a first foot pedal, and a second foot pedal;

the first leg and the second leg being connected coplanar to the bottom base;

the first leg being positioned perpendicular and adjacent to the first front post;

the second leg being positioned perpendicular and adjacent to the second front post;

the first leg and the second leg being positioned parallel and offset from each other;

the first foot pedal being laterally mounted onto the first leg;

the second foot pedal being laterally mounted onto the second leg; and the first foot pedal and the second foot pedal being electronically connected to the controller.

6. The power rack system for spotting weights as claimed in claim 1 comprising:

a first display screen;

the first display screen being laterally mounted to the top base;

the first display screen being positioned in between the first front post and the second front post;

the first display screen being oriented away from the power rack frame; and the first display screen being electronically connected to the controller.

7. The power rack system for spotting weights as claimed in claim 1 comprising:

a device-mounting adjustable arm;

the device-mounting adjustable arm comprising a proximal arm end and a distal arm end; and the proximal arm end being laterally mounted to the first front post.

8. The power rack system for spotting weights as claimed in claim 7 comprising:

a second display screen;

the second display screen being pivotably mounted to the distal arm end; and the second display screen being electronically connected to the controller.

9. The power rack system for spotting weights as claimed in claim 1 comprising:

the weight-catching system further comprising a first weight catch feature and a second weight catch feature;

the first weight catch feature being terminally connected to the first racking arm, opposite the first front post; and the second weight catch feature being terminally connected to the second racking arm, opposite the second front post.

10. The power rack system for spotting weights as claimed in claim 1 comprising:

the weight-catching system further comprising a first counterfort, a first carriage, a second counterfort, and a second carriage;

the first carriage being slidably connected onto the first front post;

the first racking arm being positioned perpendicular to the first front post;

the first racking arm being connected onto the first carriage, opposite to the first front post;

the first counterfort being connected in between the first racking arm and the first carriage;

the second carriage being slidably connected onto the second front post;

the second racking arm being positioned perpendicular to the second front post;

the second racking arm being connected onto the second carriage, opposite to the second front post; and the second counterfort being connected in between the second racking arm and the second carriage.

11. The power rack system for spotting weights as claimed in claim 1 comprising:

the plurality of lateral posts being positioned parallel and offset from each other;

each of the plurality of lateral posts being positioned normal to the top base and the bottom base; and each of the plurality of lateral posts being connected in between the top base and the bottom base.

12. A power rack system for spotting weights comprising:

a power rack frame;

a weight-catching system;

a controller;

a device-mounting adjustable arm;

the power rack frame comprising a plurality of lateral posts, a top base, and a bottom base;

the weight-catching system comprising a first racking arm, a second racking arm, an upper support beam, a lower support beam, and at least one chain drive mechanism;

the plurality of lateral posts comprising a first front post and a second front post;

the weight-catching system further comprising a first leg, a second leg, a first foot pedal, and a second foot pedal;

the at least one chain drive mechanism comprising a first chain drive mechanism, a second chain drive mechanism, and at least one drive bar;

the first chain drive mechanism and the second chain drive mechanism each comprising a transmission chain, a drive gear, a driven gear, a motor, and at least one coupler;

the plurality of lateral posts, the top base, and the bottom base being arranged into a prismatic configuration;

the first front post and the second front post being positioned parallel and adjacent to each other;

the upper support beam and the lower support beam being mounted in between the first front post and the second front post;

the upper support beam and the lower support beam being positioned parallel and offset from each other;

the at least one chain drive mechanism being mounted in between the upper support beam and the lower support beam;

the first racking arm being slidably mounted along the first front post;

the second racking arm being slidably mounted along the second front post;

the at least one chain drive mechanism being operatively coupled to the first racking arm and the second racking arm, wherein the at least one chain drive mechanism is used to simultaneously raise and simultaneously lower the first racking arm and the second racking arm;

the controller being mounted within the power rack frame;

the at least one chain drive mechanism being electronically connected to the controller;

the first leg and the second leg being connected coplanar to the bottom base;

the first leg being positioned perpendicular and adjacent to the first front post;

the second leg being positioned perpendicular and adjacent to the second front post;

the first leg and the second leg being positioned parallel and offset from each other;

the first foot pedal being laterally mounted onto the first leg;

the second foot pedal being laterally mounted onto the second leg;

the first foot pedal and the second foot pedal being electronically connected to the controller;

the at least one drive bar being connected in between the first racking arm and the second racking arm;

the transmission chain being tensionally engaged about the drive gear and the driven gear;

the motor being operatively coupled to the drive gear, wherein the motor is used to rotate the drive gear;

the motor being electronically connected to the controller;

the at least one drive bar being laterally mounted to the transmission chain by the at least one coupler;

the device-mounting adjustable arm comprising a proximal arm end and a distal arm end; and the proximal arm end being laterally mounted to the first front post.

13. The power rack system for spotting weights as claimed in claim 12 comprising:

the drive gear of the first chain drive mechanism and the driven gear of the second drive mechanism being rotatably mounted to the upper support beam;

the drive gear of the first chain drive mechanism and the driven gear of the second chain drive mechanism being positioned offset from each other along the upper support beam;

the drive gear of the second chain drive mechanism and the driven gear of the first chain drive mechanism being rotatably mounted to the lower support beam; and the drive gear of the second chain drive mechanism and the driven gear of the first chain drive mechanism being positioned offset from each other along the lower support beam.

14. The power rack system for spotting weights as claimed in claim 12 comprising:

the weight-catching system further comprising at least one first sensor and at least one second sensor;

the first racking arm and the second racking arm each comprise a weight-receiving surface;

the weight-receiving surface being oriented towards the top base;

the at least one first sensor being integrated into the weight-receiving surface of the first racking arm;

the at least one second sensor being integrated into the weight-receiving surface of the second racking arm; and the at least one first sensor and the at least one second sensor being electronically connected to the controller.

15. The power rack system for spotting weights as claimed in claim 12 comprising:

a first display screen;

the first display screen being laterally mounted to the top base;

the first display screen being positioned in between the first front post and the second front post;

the first display screen being oriented away from the power rack frame; and the first display screen being electronically connected to the controller.

16. The power rack system for spotting weights as claimed in claim 12 comprising:

a second display screen;

the second display screen being pivotably mounted to the distal arm end; and the second display screen being electronically connected to the controller.

17. The power rack system for spotting weights as claimed in claim 12 comprising:

the weight-catching system further comprising a first weight catch feature and a second weight catch feature;

the first weight catch feature being terminally connected to the first racking arm, opposite the first front post; and the second weight catch feature being terminally connected to the second racking arm, opposite the second front post.

18. The power rack system for spotting weights as claimed in claim 12 comprising:

the weight-catching system further comprising a first counterfort, a first carriage, a second counterfort, and a second carriage;

the first carriage being slidably connected onto the first front post;

the first racking arm being positioned perpendicular to the first front post;

the first racking arm being connected onto the first carriage, opposite to the first front post;

the first counterfort being connected in between the first racking arm and the first carriage;

the second carriage being slidably connected onto the second front post;

the second racking arm being positioned perpendicular to the second front post;

the second racking arm being connected onto the second carriage, opposite to the second front post; and the second counterfort being connected in between the second racking arm and the second carriage.

19. The power rack system for spotting weights as claimed in claim 12 comprising:

the plurality of lateral posts being positioned parallel and offset from each other;

each of the plurality of lateral posts being positioned normal to the top base and the bottom base; and each of the plurality of lateral posts being connected in between the top base and the bottom base.

* * * * *